United States Patent [19]

Seragnoli

[11] 3,972,408

[45] Aug. 3, 1976

[54] DEVICE FOR ALIGNING DELICATE OBLONG PRODUCTS, SUCH AS CHOCOLATES, ON A CONVEYOR

[75] Inventor: Enzo Seragnoli, Bologna, Italy

[73] Assignee: G. D. Societa per Azioni, Italy

[22] Filed: Nov. 8, 1974

[21] Appl. No.: 522,298

[30] Foreign Application Priority Data

Nov. 21, 1973 Italy ..... 3530/73

[52] U.S. Cl. ..... 198/29

[51] Int. Cl.[2] ..... B65G 47/22

[58] Field of Search ..... 198/20 R, 21, 24, 26, 198/34, 37, 29, 30, 106; 53/64, 73; 221/251

[56] References Cited

UNITED STATES PATENTS

| | | | |
|---|---|---|---|
| 2,734,657 | 2/1956 | Drese | 221/251 |
| 3,044,660 | 7/1962 | Troll et al. | 221/251 |
| 3,160,259 | 12/1964 | Dalton | 198/21 |
| 3,407,916 | 10/1968 | Engeler | 198/24 |

*Primary Examiner*—John J. Love
*Assistant Examiner*—Joseph E. Valenza
*Attorney, Agent, or Firm*—Robert E. Burns; Emmanuel J. Lobato; Bruce L. Adams

[57] ABSTRACT

A device for aligning soft oblong products, such as chocolates, being fed towards a wrapping machine, to make sure that the major axis of the products will not be displaced from its proper direction, parallel with the direction in which the transporting conveyor moves. Laterally of the conveyor there are two guide walls. At the downstream end of the conveyor there is a stop for halting the products. One of the guide walls carries a movable wall, which is displaced perpendicularly to the conveyor so that it comes up against the sides of the oblong shaped products and aligns the major axis of those products with the direction in which the conveyor moves.

5 Claims, 2 Drawing Figures

DEVICE FOR ALIGNING DELICATE OBLONG PRODUCTS, SUCH AS CHOCOLATES, ON A CONVEYOR

BACKGROUND OF THE INVENTION

This invention relates to the field of wrapping machines which are able, for example, to wrap confectionery products particularly delicate to the touch and, more precisely, it has as its subject an improvement for the infeeding of products that are oblong in shape, and of such texture as chocolates, to a wrapping machine and envisages the use of a device for unidirectionally positioning the said products at a point prior to where they are transferred to the wrapping machine.

DESCRIPTION OF THE PRIOR ART

The customary practice with the known technique is to infeed products of the above mentioned type to the wrapping machines by means of devices consisting essentially of an endless, continuously moving, conveyor belt on which the articles or products to be wrapped are placed irregularly.

According to the customary technique, the products are carried on the conveyor belt up to a fixed stop against which they rest and build up into a continuous row of products, in generally endwise contact with one another.

The said products are then transferred, one at a time, by transfer means from the stop to the wrapping machine.

Recently in order to make available a device able to supply the wrapping machine with products at the same speed at which the said products themselves arrive at the infeed device, the assignees of this application constructed, according to Italian Patent No. 877,130, a device consisting of two endless conveyor belts, placed one after the other, both of which move in the same direction but at different speeds.

The slower belt is intended to receive the products placed thereon in an irregular sequence and, in turn, to supply them to the faster belt, by which they are taken, as already seen, up against the stop. From there they are fed to the wrapping machine.

In this case too the products that are gradually accumulated against the fixed stop form a continuous line, of a length variable with the infeed variations of the first slower moving conveyor belt.

From what has been said, it ensues that the products that go to make up the continuous line from the fixed stop onwards are subjected to a rhythmic sliding action on the transportation means and that the frequency of this corresponds with the frequency at which they are infed to the wrapping machine.

Furthermore, the patented device comprises sensors, for example, of the photoelectric type, placed along the path along which the faster belt travels and suitably spaced ahead of the fixed stop, whose task it is to cause the operating speed of the wrapping machine to be increased or decreased, depending upon whether the accumulated row or continuous line of products is of the length selected as the maximum or of the length selected as the minimum.

Fixed walls, the purpose of which is to guide the products, are also provided throughout the path followed by the conveyor belts.

As stated previously, the present invention relates to the specific case of oblong products (for example, as depicted in FIG. 1, with a flat elliptic base) being fed to the wrapping machine.

For known reasons, products of this particular shape are placed on the conveyor means in such a way that they move forwards towards the fixed stop in the direction of their major axis.

While the transfer operation is being carried out, however, there is the possibility that the said oblong shaped products may adopt an incorrect position, that is to say, that their major axis may take on a certain slant with respect to the infeed direction. Although displacements of this nature are kept within certain limits by the guide walls, they are nevertheless the cause of annoyance and difficulties and thus prejudice the smoothness of the infeed to the wrapping machine.

This phenomenon occurs right along the continuous line ahead of the fixed stop since it is generated by interaction between one product and another and by their rhythmic sliding action on the belt.

In limit cases it can even happen that, because of its oblong shape, a product can get partially wedged between the product preceding it and the fixed wall, the consequential result of which is that the infeed flow is halted and that the products, which as stated above, are extremely delicate, suffer damage.

SUMMARY OF THE INVENTION

The object of the present invention is, therefore, to make available a device for the infeeding of oblong shaped products, such as for example, chocolates, which is able to guarantee a normal infeed flow towards the wrapping machine, that is to say, a device with which the difficulties to which mention has been made above stemming from the major axis of the products taking on a slant with respect to the direction in which the conveyor belts move forward, can be prevented from occurring.

A further object of the present invention is to make available a device able to achieve the foregoing in a particularly simple and relatively inexpensive way.

These and other objects too have all been attained with the device according to the invention for unidirectionally positioning products, particularly oblong products such as chocolates and similar. The device employs an infeed channel, delimitated at the bottom by continuously moving belt means for carrying the products, one after the other, in the direction of their major axis, and laterally by guide walls; a stop at the far end of the channel against which the products accumulate and form a continuous line; and means for removing successive stopped products from the channel adjacent the stop. According to the invention the aforementioned device, used for unidirectionally positions the products comprises at least one movable wall and means for causing it to move perpendicularly to the infeed direction of the conveyor belts in such a way that it comes up against the sides of the products, the movable wall extending from adjacent the downstream end of the channel in an upstream direction along the above mentioned continuous line of products.

BRIEF DESCRIPTION OF THE DRAWINGS

Further characteristics and advantages will emerge more clearly from the following detailed description of a preferred form of embodiment for the device according to the invention, illustrated purely as an example on the accompanying drawings in which.

DESCRIPTION OF THE PREFERRED EMBODIMENT

Figure 1:
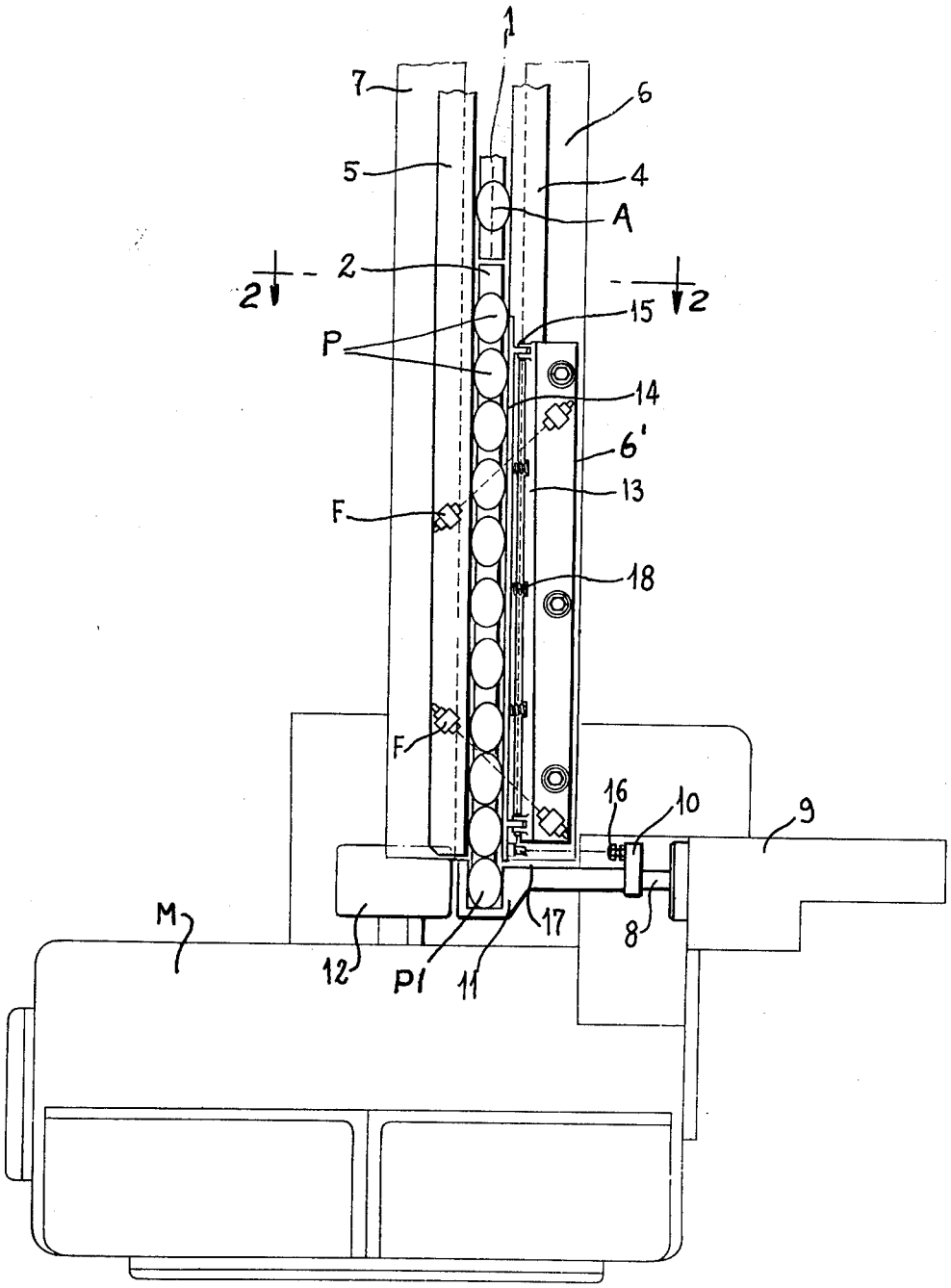
FIG. 1 shows, in a plan view, the device in question.
Figure 2:
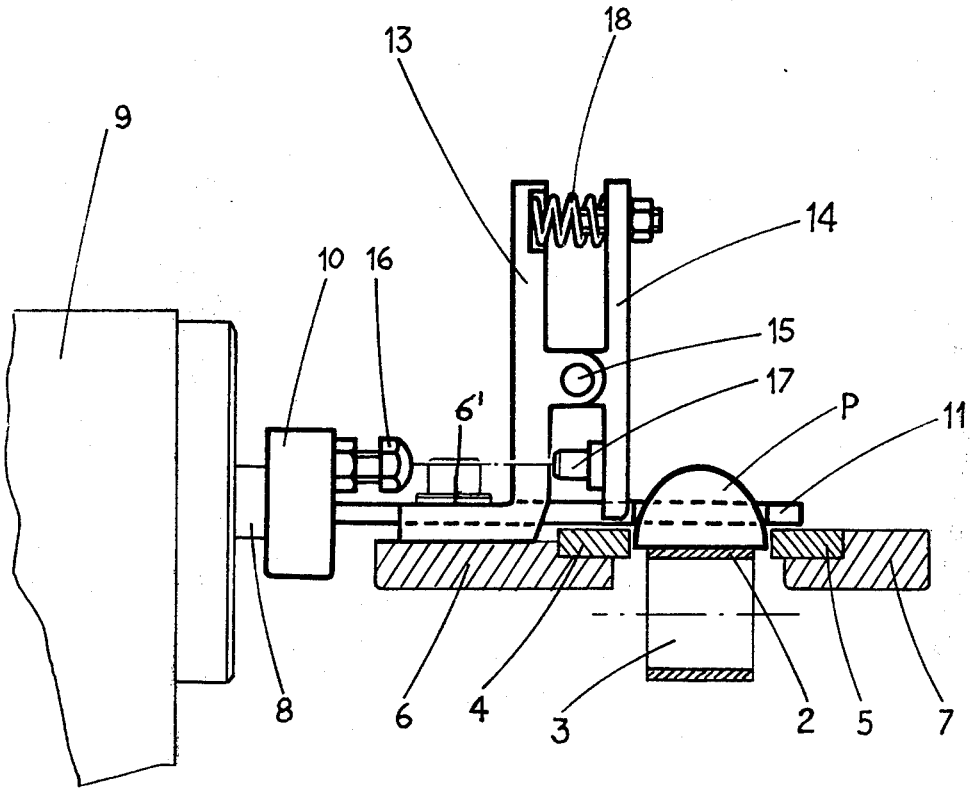
FIG. 2 shows, on a larger scale and partly in section, an elevation of the said device, seen along the line in FIG. 1 2—2.

With reference to FIGS. 1 and 2, two endless conveyor belts 1 and 2, placed one after the other, move continuously in the same direction held under tension by horizontal spindle mounted rollers 3, one of which can be seen in FIG. 2.

As shown in FIG. 1, a stream of generally uniform, oblong products, P, each with a flat elliptic base, is carried by the conveyor belt 1 and to the faster moving conveyor belt 2, at the far or downstream end of which a transfer means 11 operates for transferring them toward the wrapping machine M. The products are of delicate texture, such as chocolate, as noted above.

At both sides of the conveyor belts 1 and 2 walls are provided and these, 4 and 5, respectively, are integral with the frame of the device, the former through a plate 6 and the latter through a plate 7. Both walls are shown as relatively low tracks, just sufficiently high to constitute a guide for the products P.

Photoelectric sensor devices F are placed along the conveyor belt 2, the purpose of these being, as previously stated, to regulate the operating speed of the wrapping machine M to suit variations in the infeed of the products P coming from the conveyor belt 1.

At 8 there is a horizontal shaft, perpendicular with respect to the direction in which the conveyor belts 1 and 2 move forward, supported by the frame 9 of the wrapping machine M and provided with a reciprocating axial movement.

The end of the said shaft 8, outside the frame 9, is integral with a parallelepiped block 10 to which, in turn, is fastened one end of a rod 11 which constitutes the actual means for tansferring the products P from the conveyor belt 2 to the wrapping machine M, the transfer frequency being that of the reciprocating motion of the shaft 8.

The first product P1 is inserted, at the end of conveyor belt 2, in a U shaped cavity in the other end of the rod 11 as it waits in this position.

When the shaft 8 moves forward, the product P1 slides, in and with this cavity transversely with respect to the direction in which the conveyor belts 1 and 2 travel and on to an elevator means 12 which then brings the product to the wrapping machine M.

The conveyor belts, in accordance with what has already been said, continue to operate normally while the row of products P is prevented from moving by the side of the rod 11 which serves as a stop.

When the transfer means returns to its starting position, the operation is repeated in an identical fashion.

The previously mentioned plate 6 is integral with, or as shown, bolted to a flange 6′ of, a vertical plate 13 which extends along the path followed by the belt 2.

A plate or bar structure shown as a vertical wall 14, supported by the plate 13 and placed above the fixed wall 4, is interposed between the plate 13 and the products P on belt 2. The wall 14 is able to oscillate around an axis parallel to the direction in which the conveyor belts move forward since it is pivoted by means of horizontal pins 15 to pintles integral with the plate 13.

The oscillations are achieved by a horizontal screw 16 which protrudes perpendicularly with respect to the infeed direction of the conveyor belts from the previously mentioned parallelepiped block 10. Each time the shaft 8 moves forward, this screw comes up against a stop 17 fixed on to the wall 14 below its axis of rotation 15.

During the consequential forward oscillation, the lower edge of the wall 14 comes up against the sides of the products P on the conveyor belt 2. It corrects the position of those which are incorrectly placed, that is to say, any products P whose major axis A is at an angle with respect to the direction in which the infeed belts are moving forward are slightly shifted thereby against the opposite guide track 5.

Close to the upper edge of the wall 14 in between this wall and the plate 13, are interposed springs 18 which compress at the time the forward oscillation is taking place and, when the shaft 8 is retracted, cause the wall 14 to complete a return oscillation and resume its original position.

From the foregoing it ensues that the wall 14 oscillates at the same frequency as the reciprocating motion of the rod 11 which supplies the products P to the elevator means 12 since the rod, as mentioned, is fastened to the shaft 8. This frequency, with which the wall 14 oscillates in a direction perpendicular to the direction in which the conveyor belts move forward, prevents the products P, in the continuous line rhythmically obstructed by the side of the rod 11 and thus subjected to a sliding action on the belt 2, from undergoing displacements of sufficient magnitude to cause them to jam and damage one another and/or to undergo damage by impinging against the fixed walls 4 and 5.

What is claimed is:

1. A conveyor device comprising;

a conveyor belt movable in a certain direction to carry a stream of elongated products disposed in general axial alignment with said direction;

first and second guide tracks, disposed at a distance from one another, respectively along first and second sides of the conveyor belt, for maintaining said general alignment, said distance being slightly wider than the elongated products;

means at a downstream end of the conveyor belt for stopping the products to cause a row of the products in endwise contact with one another to accumulate while the conveyor belt slidingly moves below the accumulated row of products, and for removing successive ones of the stopped products from the accumulated row adjacent said end, transversely of said direction;

a movable structure for accurately aligning the products with said direction, in synchronism with the removing thereof, said structure being located opposite one of the guide tracks and extending from adjacent said end in an upstream direction along the accumulated row of products; and a pusher secured to the means for removing successive products, the pusher including a support and a pusher bolt adjustably threadedly secured to the support for pushing the movable structure partly across said distance against the accumulated products, to shift the accumulated products toward said one guide track and for adjusting the moving of the movable structure.

2. A device according to claim 1 in which the moving structure is supported by and on one of the guide tracks.

3. A device according to claim 1 in which the means for pushing the movable structure includes means for moving the movable structure back from the accumulated products after shifting them toward said one guide track.

4. A device according to claim 3 in which the means for moving the movable structure back from the products comprises return spring means resiliently acting on the movable structure.

5. A conveyor device according to claim 1 in which the movable structure comprises a smooth elongate bar extending along the row of accumulated products for preventing such products from becoming wedged against the guide tracks, as the conveyor belt slidingly moves below the row and the products of the row are shifted toward said one guide track.

* * * * *